US007516849B2

(12) United States Patent
Wang et al.

(10) Patent No.: US 7,516,849 B2
(45) Date of Patent: Apr. 14, 2009

(54) FROTH FLOTATION PROCESS WITH PH MODIFICATION

(75) Inventors: Guoxin Wang, Mulberry, FL (US); Francisco J. Sotillo, Mulberry, FL (US); George M. Lilley, Mulberry, FL (US)

(73) Assignee: ARR-MAZ Custom Chemicals, Inc., Mulberry, FL (US)

( * ) Notice: Subject to any disclaimer, the term of this patent is extended or adjusted under 35 U.S.C. 154(b) by 155 days.

(21) Appl. No.: 11/677,132

(22) Filed: Feb. 21, 2007

(65) Prior Publication Data

US 2008/0197053 A1 Aug. 21, 2008

(51) Int. Cl.
*B03D 1/002* (2006.01)
*B03D 1/012* (2006.01)
*B03D 1/02* (2006.01)

(52) U.S. Cl. ..... 209/166; 209/167

(58) Field of Classification Search ..... 209/166, 209/167

See application file for complete search history.

(56) References Cited

U.S. PATENT DOCUMENTS 4,720,339 A * 1/1988 Nagaraj et al. ..... 209/167
4,867,867 A 9/1989 Lilley
4,904,375 A * 2/1990 Snow ..... 209/166
5,221,466 A * 6/1993 Garcia et al. ..... 209/166
5,314,073 A * 5/1994 Sharma et al. ..... 209/166
5,542,545 A * 8/1996 Yu ..... 209/166
6,805,242 B2 10/2004 Sotillo
6,994,786 B2 2/2006 Cameron et al.

* cited by examiner

*Primary Examiner*—Thomas M Lithgow
(74) *Attorney, Agent, or Firm*—Dennis G. LaPointe

(57) ABSTRACT

This invention relates to the pH modifier in alkaline froth flotation processes to treat oxide and semi-soluble salt ores, such as phosphates, sulfates, carbonates and halides, to increase the recovery while generally maintaining or improving selectivity, thus the grade of desired minerals. The invented pH modifier is used to replace traditional alkaline pH modifiers - hydroxides, carbonates and bicarbonates, such as sodium hydroxide, sodium carbonate, lime and ammonia in anionic flotation processes. The pH modifier is aqueous solution, comprised of combinations of sodium hydroxide, sodium carbonate, and sodium silicate, along with sulfonated surfactant products, such as sulfonated petroleum oil, fatty acids, alkylates, ethoxylated alcohol ethers, and also sulfosuccinamates; and anionic polymers. The pH modifier is also used as a promoter for anionic collectors and as a depressant for gangue minerals.

3 Claims, No Drawings

FROTH FLOTATION PROCESS WITH PH MODIFICATION

FIELD OF THE INVENTION

The present invention relates to froth flotation process, which includes pH modifier-flotation promoter as replacement for the commonly used alkaline pH modifiers and gangue mineral depressants to increase the flotation recovery with improved concentrate grade of desired minerals.

BACKGROUND OF THE INVENTION

This invention is related to the use of pH modifiers in the recovery of minerals by alkaline froth flotation process.

Froth flotation is the most widely used industrial process for the separation of finely divided minerals. The flotation process involves chemical treatment on the surface of a finely divided ore in a water pulp to create conditions favorable on the surface for the attachment of certain of the mineral particles to air bubbles. The air bubbles then carry the selected minerals to the surface of the pulp to form a stabilized froth, which is removed and recovered. The unattached materials remain submerged in the pulp and is either discarded or reprocessed. A wide variety of reagents, such as pH modifiers, collectors, frothers, and other bulk and surface modification reagents are used in froth flotation. Alkaline flotation with conditioning or flotation pH greater than 7 is widely used for beneficiation of oxide and semi-soluble salt minerals, such as apatite, barite, fluorite, scheelite, iron, kaolin. The most commonly used pH modifiers for alkaline flotation are caustic soda, soda ash, lime and ammonia. Some of the most used collectors, such as fatty acids and their derivatives, are thought to be effective collectors for oxidized mineral ores. However, a major challenge associated with the recovery of alkaline flotation is selectivity, thus the grade of the desired minerals in the concentrates. The limitation of effectiveness of the flotation process could be partially attributed to the pH modifier. Other problems associated with some pH modifiers are high consumption, foaming, and environmental concern. The invented pH modifier is intended to overcome the limitations of the traditional pH modifiers and at the same time to improve the alkaline flotation process as a promoter.

Phosphate rock in Florida is a typical sedimentary siliceous phosphate consisting of calcium phosphate in form of apatite together with clay, sand and other gangue minerals. The appropriately sized flotation feed with typical grade of 3 to 10% $P_2O_5$ is obtained through logging, washing, desliming and sizing. The feed in thick slurry is conditioned with pH modifier, fatty acids, fuel oil, and other co-collectors at pH 8.5 to 10. Sodium silicate sometimes is added as a silica depressant. The slurry is subsequently floated by conventional froth flotation routes. A rougher concentrate with typical grade of 20 to 30% $P_2O_5$ and 15-40% silica sand is acid-scrubbed, rinsed free of reagents, and subjected to a reverse cationic flotation to further remove the silica sand at pH 6.5 to 7.5. The final phosphate concentrate is produced with the double flotation process with typical grade ranging from 30 to 34% $P_2O_5$ with 10-4% sand (acid insoluble). Therefore, the alkaline pH modifier and silica depressant are only applied in the first stage, the rougher flotation.

SUMMARY OF THE INVENTION

It has been found that an aqueous solution of combinations of two or three of following substances, sodium hydroxide, sodium carbonate, and sodium silicate; along with one or more than one of the sulfonated surfactant products, such as sulfonated petroleum oil, fatty acids, alkylates, ethoxylated alcohol ethers, and also sulfosuccinamates; and anionic polymers is an effective pH modifier. It can replace the traditional alkaline pH modifiers, such as caustic soda, soda ash, lime and ammonia during the flotation process of oxide minerals like phosphate. Moreover, it can enhance the anionic collectors' flotation performance as a promoter to obtain high recovery and good selectivity. It can also depress silicate minerals as a depressant. In accordance of the present invention, the alkaline flotation of Florida phosphates is modified at pH range of 8.5 to 10.5 by the invented pH modifier with a blend comprising sodium hydroxide, sodium carbonate, sodium silicate, surfactants, anionic polymers and water.

The practice of the flotation process of this invention results in increasing recovery of the phosphate while maintaining or improving the selectivity, thus the grade of the phosphate rougher concentrate.

DETAILED DESCRIPTION OF THE INVENTION

This disclosure describes the use of aqueous solutions of combinations of two or three of following substances, sodium hydroxide, sodium carbonate, and sodium silicate; along with one or more than one of the sulfonated surfactant products, such as sulfonated petroleum oil, fatty acids, alkylates, ethoxylated alcohol ethers, and also sulfosuccinamates; and anionic polymers in different ratios as pH modifier-promoter for alkaline froth flotation processes, in which Florida phosphate flotation is taken as an example. This invented pH modifier has three functions during the phosphate flotation. It can be used as a pH modifier to replace the traditional alkaline pH modifier, such as caustic soda, soda ash, and ammonia; as a promoter to increase the efficiency of anionic collector adsorption and further improving the rougher recovery; as a depressant to replace sodium silicate.

The invented pH modifier can be blended with various content percentages of sodium hydroxide, sodium carbonate, sodium silicate, surfactants and/or anionic polymers, and balanced with water. The blending percentage will vary with each typical ore processed and therefore cannot be set to specific limits. This percentage can be readily ascertained by one skilled in the art by ordinary experimentation.

The effectiveness of this invention can be demonstrated in the laboratory and in the pilot plant trial at industrial scale.

EXAMPLE 1

A pH modifier, Custo-pH 11, was prepared with sodium hydroxide 0 to 20%, sodium carbonate 0 to 20%, sodium silicate 0 to 20%, and surfactants 0 to 20%, balanced with water. For comparison, soda ash solution with the same % solids was used as the traditional pH modifier.

This test was done in the laboratory in a 3-liter Denver cell using feed obtained from Central Florida phosphate mine 1. A sample of about 700-g feed was first conditioned at 70% solids with 0.3 pounds/ton of feed of the formulated flotation reagent for 120 seconds at 1500 rpm at pH 9.3. The sample was then diluted to 20% solids and floated at 1300 rpm for 60 seconds at alkaline pH. The froth product and the flotation tailing were dried, weighed, and analyzed for $P_2O_5$ content by a spectroscopic method.

The pH modifier Custo-pH 11 generated a higher-grade concentrate with higher recovery than using soda ash as pH modifier. The grade of rougher concentrates increased 2.65% $P_2O_5$ while recovery increased 2.5%. The consumption of Custo-pH is lower than that of soda ash too.

| pH modifier | | Feed | | Concentrate | | Tail | | Recovery |
|---|---|---|---|---|---|---|---|---|
| (10% solid) | g | Weight | % P2O5 | Weight | % P2O5 | Weight | % P2O5 | % |
| Soda ash | 2.1 | 702.5 | 3.55 | 143.5 | 14.56 | 559.0 | 0.73 | 83.7 |
| Custo-pH 11 | 1.0 | 702.4 | 3.54 | 124.5 | 17.21 | 577.9 | 0.59 | 86.2 |

EXAMPLE 2

A pH modifier, Custo-pH 117, was prepared with sodium hydroxide 0 to 30%, sodium silicate 0 to 20%, sulfonated surfactants 0 to 10%, and Polymer 1111 0-5% balanced with water. For comparison, soda ash solution with the same % solid was used as the traditional pH modifier.

Flotation experiments were conducted in a 3-liter Denver cell using feed obtained from Central Florida phosphate mine 2. A sample of about 700-g feed was first conditioned at 70% solids with 0.65 pounds/ton of feed of the formulated flotation reagent for 120 seconds at 1500 rpm at pH 9.4. The sample was then diluted to 20% solids and floated at 1300 rpm for 60 seconds at alkaline pH. The froth product and the flotation tailings were dried, weighed, and analyzed for $P_2O_5$ content by a spectroscopic method. The results showed Custo-pH 117 improved the flotation selectivity with increased recovery. The recovery has 4.6% improvement while the grade with 16.7% improvement.

| pH modifier | | Feed | | Concentrate | | Tail | | Recovery |
|---|---|---|---|---|---|---|---|---|
| (10% solid) | g | Weight | % P2O5 | Weight | % P2O5 | Weight | % P2O5 | % |
| Soda ash | 2.8 | 707.9 | 5.29 | 159.2 | 20.85 | 548.7 | 0.77 | 88.7 |
| Custo-pH 117 | 1.2 | 706.9 | 5.25 | 141.6 | 24.33 | 565.3 | 0.48 | 92.8 |

EXAMPLE 3

A pH modifier, Custo-pH 1 was developed with sodium hydroxide 0 to 20%, sodium silicate 0 to 20%, and sulfonated surfactants 0 to 10% with balance of water. Custo-pH 1 was pilot plant tested in a Central Florida phosphate flotation facility for 3 days on both coarse and fine feed circuits. For this test, Custo-pH 1 was mixed online with soda ash solution with same % solids at ratio of one to one for adjusting conditioning pH. A formulated flotation reagent, Custofloat, was used with fuel oil in the tests as the anionic collector. A soda ash solution as the traditional pH modifier was used on an alternate day for comparison. Results were expressed as BPL (bone phosphate lime). Better recoveries with about 1.5% increase were obtained with the invented pH modifier with approximately same concentrate grades.

| pH modifier | | Conditioning | Fatty acid | Fuel | Fine Feed | | Concentrate | Tail | Recovery |
|---|---|---|---|---|---|---|---|---|---|
| (10% solid) | gpm | pH | lb/t | lb/t | TPH | % BPL | % BPL | % BPL | % |
| Soda ash | 4.00 | 9.43 | 1.20 | 0.70 | 222.0 | 10.35 | 44.04 | 0.87 | 93.3 |
| Custo-pH 1+ | 2.10 | 9.35 | 1.30 | 0.70 | 223.0 | 9.93 | 45.33 | 0.65 | 94.8 |

| pH modifier | | Conditioning | Fatty acid | Fuel | Coarse Feed | | Concentrate | Tail | Recovery |
|---|---|---|---|---|---|---|---|---|---|
| (10% solid) | gpm | pH | lb/t | lb/t | TPH | % BPL | % BPL | % BPL | % |
| Soda ash | 3.90 | 9.90 | 0.83 | 0.35 | 228.0 | 20.67 | 60.86 | 1.34 | 95.7 |
| Custo-pH 1+ | 1.96 | 9.90 | 0.85 | 0.34 | 226.0 | 21.63 | 60.20 | 0.94 | 97.1 |

What is claimed is:

1. A process for increasing a flotation recovery with improved concentrate grade of desired minerals in alkaline froth flotation processes of oxide and semi-soluble ores, the method comprising, instead of using traditional pH modifiers, including caustic soda, soda ash, lime and ammonia for pH adjustment and using soda ash or ammonia to adjust pH during fatty acid/fuel oil conditioning for rougher flotation:

using a single pH modifier comprising a combination of:

an aqueous solution of two or more of a sodium hydroxide substance, a sodium carbonate substance, and a sodium silicate substance; and a sulfonated surfactant product comprising one of a sulfonated petroleum oil, fatty acids, alkylates, ethoxylated alcohol ethers, sulfosuccinamates, and combinations thereof.

2. The process according to claim 1, wherein said pH modifier is used as a promoter for anionic collectors used in said alkaline froth flotation processes.

3. The process according to claim 1, wherein said pH modifier is used as a depressant for gangue minerals during said alkaline froth flotation processes.

* * * * *